US009272816B2

(12) United States Patent
Perttula et al.

(10) Patent No.: US 9,272,816 B2
(45) Date of Patent: Mar. 1, 2016

(54) FOOT FOR A CONTAINER

(75) Inventors: Mikael Perttula, Vantaa (FI); Aimo Karonen, Vantaa (FI); Timo Akela, Espoo (FI)

(73) Assignee: HR-GROUP OY, Helsinki (FI)

( * ) Notice: Subject to any disclaimer, the term of this patent is extended or adjusted under 35 U.S.C. 154(b) by 0 days.

(21) Appl. No.: 14/343,055

(22) PCT Filed: Aug. 29, 2012

(86) PCT No.: PCT/FI2012/050832
§ 371 (c)(1),
(2), (4) Date: Mar. 6, 2014

(87) PCT Pub. No.: WO2013/034800
PCT Pub. Date: Mar. 14, 2013

(65) Prior Publication Data

US 2014/0197182 A1 Jul. 17, 2014

(30) Foreign Application Priority Data

Sep. 6, 2011 (FI) ..... 20115872

(51) Int. Cl.
*B65D 25/24* (2006.01)
*B65D 90/14* (2006.01)

(52) U.S. Cl.
CPC ..... *B65D 25/24* (2013.01); *B65D 90/143* (2013.01)

(58) Field of Classification Search
CPC ..... B65D 25/24; B65D 25/20; B65D 90/14; B65D 90/143; B65D 2313/04
USPC ..... 220/630, 628, 634, 653, 654, 651, 647, 220/646, 1.5; 248/151, 146, 599, 649, 673, 248/677, 165; 217/36, 43 R, 12 R
See application file for complete search history.

(56) References Cited

U.S. PATENT DOCUMENTS 4,090,722 A 5/1978 Hannan

FOREIGN PATENT DOCUMENTS

| | | |
|---|---|---|
| GB | 2165221 | 4/1986 |
| JP | H08230976 | 9/1996 |
| WO | 2010057313 | 5/2010 |

*Primary Examiner* — Robert J Hicks
(74) *Attorney, Agent, or Firm* — Mark M. Friedman

(57) ABSTRACT

The invention relates to a foot for a container (1) which is detachable from and attachable to the container and which consists of a vertical elongated foot stem (2) which will be situated against the container and which has attachment locks (3, 4, 4*b*) which will be situated in the container. One attachment lock (3), which preferably is the lower lock, consists of a fixed locking tongue (5) which is in the foot stem and which can be pushed (6) into the locking corner in the container (1) and which can be turned (7) into the locking position, at which the foot stem (2) becomes locked into the container. The other attachment lock (4, 4*b*), which preferably is the upper lock, is a hook shaped locking bolt which can be locked into another locking corner in the container.

6 Claims, 5 Drawing Sheets

FOOT FOR A CONTAINER

TECHNICAL FIELD

The invention is directed to a foot for a container which is detachable from and attachable to the container.

BACKGROUND

For example, the patent specification CH-695454, the published application WO 96/06028, the U.S. Pat. No. 4,045,000 and the utility model FR 8518622 disclose feet for a container and various solutions for attaching feet to the containers which are known per se. One common property of all of these techniques is that the solutions are extremely complicated containing many moving parts. These known solutions raise the price and make the structures unsafe.

The Finnish patent application 20040846 "Method for loading sea containers and container foot applicable for the purpose" discloses the prior art. The publication al-so discloses how and where detachable container feet are required.

For example, so-called SWAP containers used in sea transporters have fixed feet which are rotatable under the container. A similar type of solution is also in so-called foot pallet containers which have fixed feet and which are intended for road transports. However, these impose extra weight and need their own space both in land and sea transports, and this is a major disadvantage particularly in sea transport. The containers which are equipped with fixed feet are also more expensive than containers without feet. The present solutions are on the whole, as mentioned earlier, complicated by their technical solutions.

The detachable container feet are intended for lifting the sea container into and away from the carriage without needing an expensive crane and without, however, equipping the container with fixed feet. The container equipped with the detachable and attachable container feet can be left with the customer for loading and unloading, even for several days, and the carriage can be utilized for some other use at that time. The present container is the type that adheres to a global common standard. It has become common also outside sea traffic such that many containers never are transported by sea but they are only used in road transports and for storing goods. In other words, the container according to the "standard" can be transported just as well on land in motor vehicles as well as on the sea in ship transports without the extra weight and need for space due to the feet or the cranes, and each transport operator, truck etc. and goods station has its own inexpensive, light and safe detachable container feet which fit all containers because they are a standard type.

SUMMARY OF INVENTION

The aim of this invention is to provide a novel type of foot for a container which is stable, safe, light and easy to attach and detach. The foot for a container according to the invention is detachable from and attachable to the container and consists of a vertical elongated foot stem which will be situated against the container and which has an attachment lock which will be situated in the container; it is characterized by the presence of a locking tongue of the attachment lock that consists of a horizontal shaft at the end of which, on both sides, there are locking claws so that the locking tongue can be pushed into the locking corner in the container essentially at 90° (FIG. 3), i.e. the foot stem is in the horizontal position after which the foot stem is turned into a vertical position, at which the locking tongue becomes locked into the locking corner.

The object of this invention is to provide a foot for a container which is detachable from and attachable to the container and which consists of a vertical elongated foot stem which will be situated against the container and which has an attachment lock which will be situated in the container and which can be pushed into a locking corner in the container.

When a carriage which is equipped with height adjustment and loaded with a container is at its maximum height and all four feet have been attached to the container, the container is detached from the carriage and the carriage is lowered to its minimum height. Then the container will remain supported by its feet and the carriage can be driven away. Similarly, when a carriage which is not loaded with a container and which is equipped with a height adjustment is driven, adjusted to its minimum height, under the container which rests supported by the detachable feet according to the invention, and after this procedure, the carriage is shifted to its maximum height, the container can be loaded onto the carriage and the detachable feet according to the invention can be detached. The structure and material of these container feet are such that they can be manufactured so light that even one man can handle them, without however, sacrificing their necessary strength and safety.

BRIEF DESCRIPTION OF DRAWINGS

The invention will be described in the following by means of an example and by referring to the attached drawings in which.

DETAILED DESCRIPTION OF DRAWINGS

Figure 3:
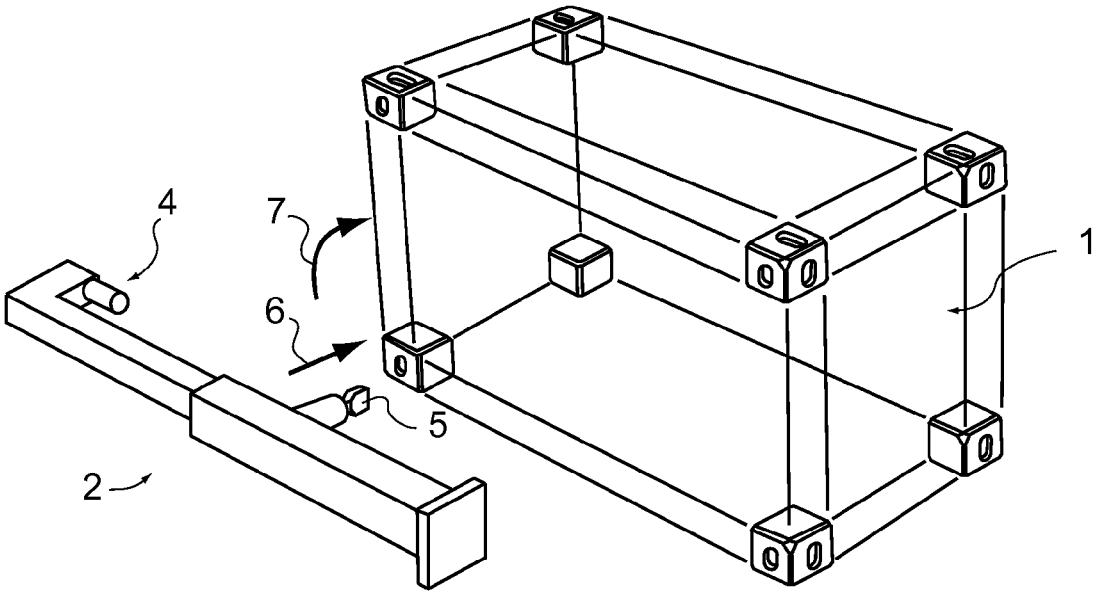
FIG. 3 shows the attachment of the foot, FIG. 2*a*, to the lower corner of the container.
Figure 4:
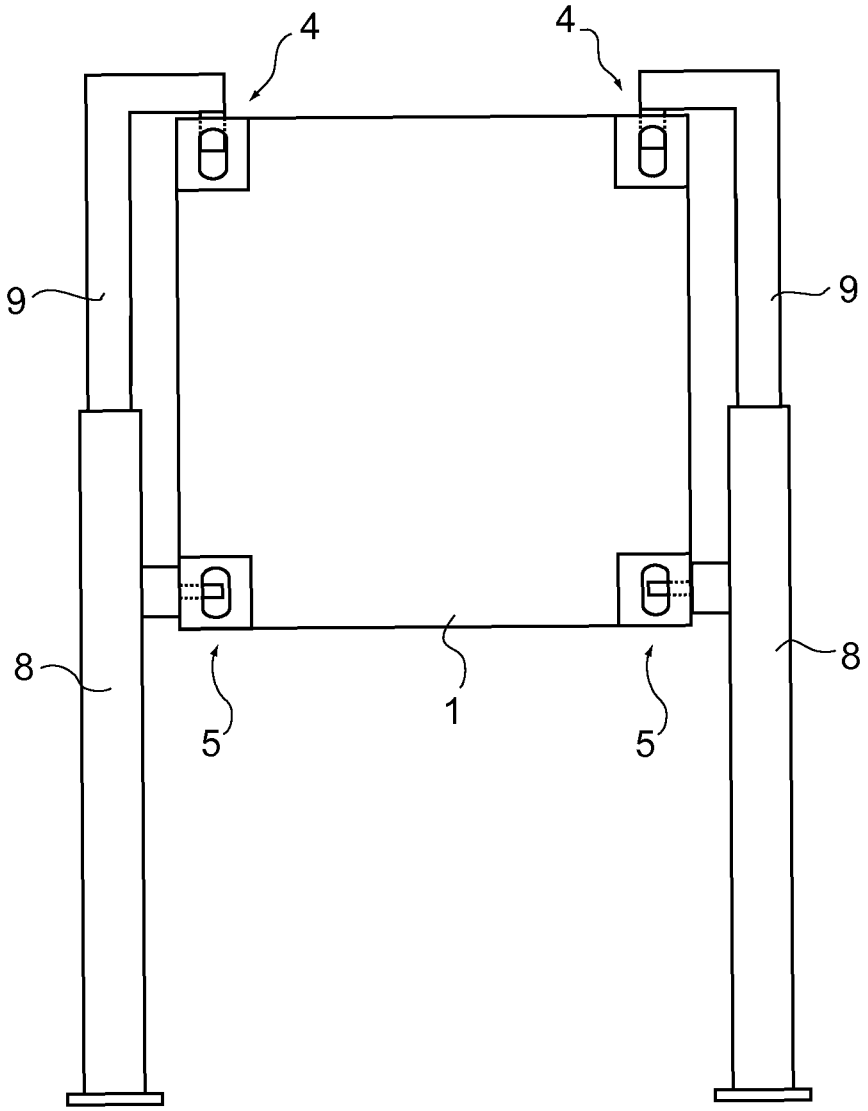
FIG. 4 shows a container which has been equipped with feet according to the invention and which is supported by the feet.

The foot for the container which is detachable from and attachable to the container 1 consists of a vertical elongated foot stem 2 which will be situated against the container and which has attachment locks 3, 4 which will be on the container. The lower attachment lock 3 consists of a fixed locking tongue 5 which is in the foot stem and which can be pushed, arrow 6, into the locking corner in the container, FIG. 3, and which can be turned, arrow 7, into the locking position, at which the foot stem 2 becomes locked into the container 1.

The upper attachment lock 4 is a hook shaped locking bolt which can be locked into the other, i.e the upper locking corner in the container.

The foot stem 2 consists of two pipe frames, a supporting frame 8 and a locking frame 9, which move telescopically with respect to each other, wherein the fixed locking tongue 5 is attached to the supporting frame 8 and the locking bolt 4 is attached to the locking frame 9. The locking tongue 5 consists of a horizontal shaft at the end of which, on both sides, there are locking claws so that the locking tongue can be pushed 6 into a locking corner in the container 1 essentially at 90°, i.e. the foot stem 2 is in a horizontal position, FIG. 3, after which the foot stem is turned into a vertical position, arrow 7, at which the locking tongue becomes locked into the locking corner. The locking bolt 4 in the locking stem 9 is moved with a telescopic movement of the locking stem into the upper locking corner in the container, at which the foot of the container is locked attached to the container. The locking bolt 4 is hook shaped so that the end of the hook which is pointing downwards rests into the upper hole of the locking corner of the container.

Figure 5:
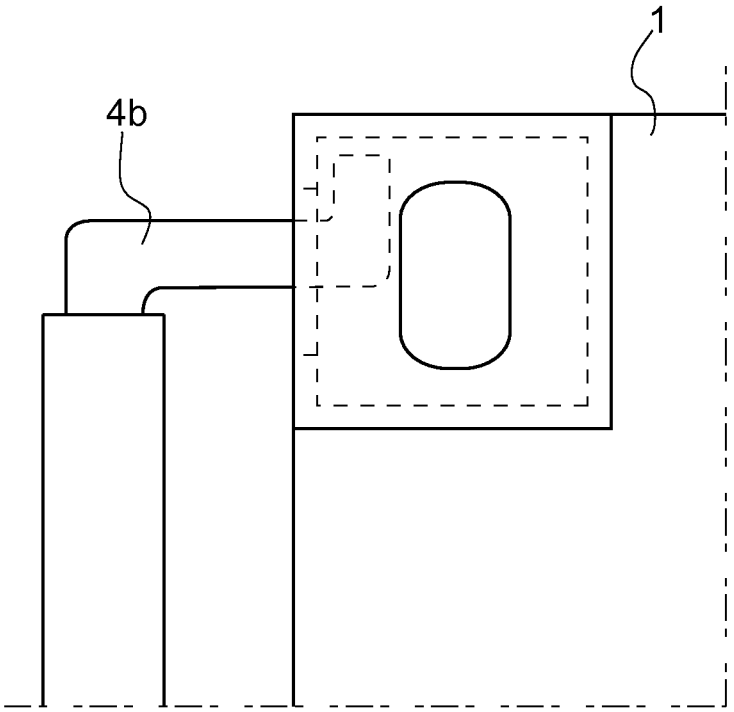
FIG. 5 shows an embodiment wherein the locking bolt is shaped like a hook so that the end of the hook which is pointing upwards rests in the side hole of the locking corner of the container.

In FIG. 5 the locking bolt 4*b* resembles a hook so that the end of the hook which is pointing upwards rests in the side hole of the locking corner of the container. The locking stem 9 can additionally be spring-loaded so that the locking bolt 4*b* is in the locking position constantly upwards spring-loaded and thus remains safely in the locking position.

Figure 6:
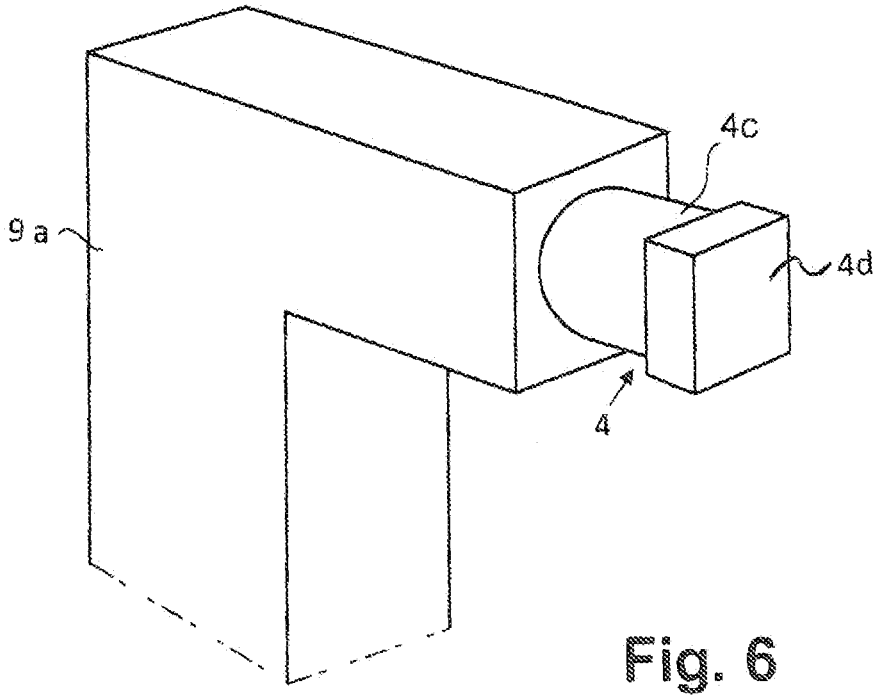
FIG. 6 shows an embodiment wherein the locking bolt is a shaft at the end of which there is a square-shaped flat plate.
Figure 7:
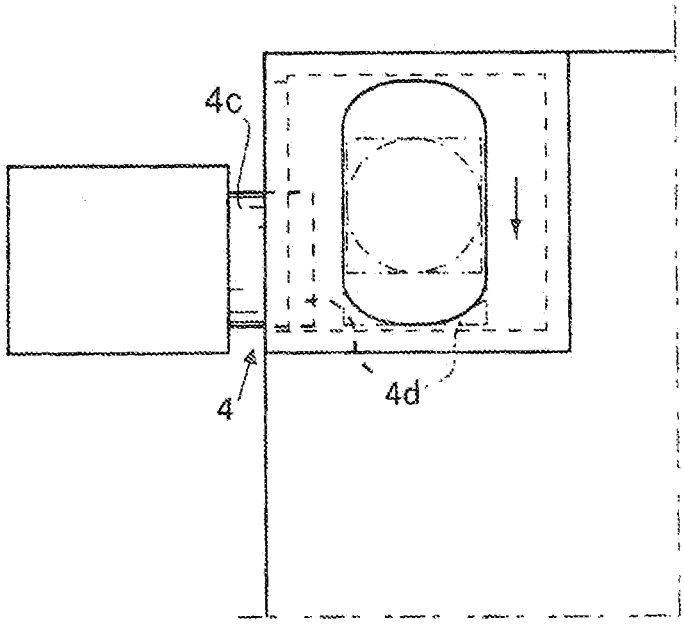
FIG. 7 shows the attachment of the locking bolt of FIG. 6 into the container.

In FIG. 6, the locking bolt 4 consists of a shaft 4*c* which is at the top end of the locking stem 9*a* and at the end of which there is a square-shaped flat plate 4*d* which acts as a locking element in the hole of the locking corner in the container. In FIG. 7 there is a locking bolt 4 installed in the hole of the locking corner. The dash-dotted line in the front hole shows the position of the locking bolt when it is pushed into the hole, after which it is dropped, in the direction shown by the arrow, down to the locking position, as shown by the figure on the left.

At the top part of the locking stem there can be additionally a magnet which draws the top part of the locking stem into the container and thus helps in the control and attachment of the top part at the top part of the container. The magnet has not been shown in the figures.

The pipe frames 8, 9 are A1 square pipes, and pressfit laminated timber which stiffens the structure has been presses inside the pipes. The pipe frames can also be some other material which is suitable for purposes, such as glass/carbon fibre, steel, light metal alloy etc.

The pipe frames 8, 9 can additionally be shaped in such a way that the upper and/or lower part can be either partly or totally leaning against the container and thus provide extra support to the foot of the container. There can also be support elements in the pipe frames, such as short "feet" which lean against the container. The top part of the locking stem 9*a* can also be bent so that the top part is leaning against the container. The foot of the container can also be a three-part telescope which fits, for example, transversely under the container for storage when it is taking part in the transport. The foot of the container can also be simply single-part, at which the top part of the foot leans against the vertical cavities of the wall of the container. There can also be a simple pivot in the top part which protrudes into the locking corner in the upper corner of the container and remains in place due to the weight of the container which presses the top part of the foot towards the container.

Figure 1:
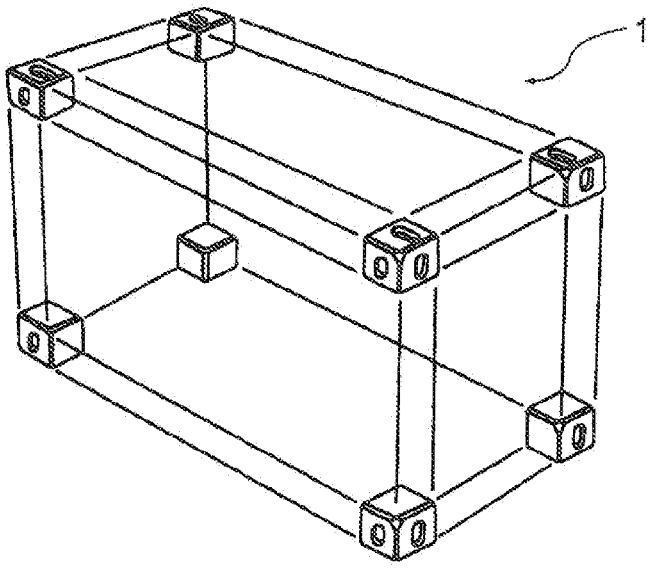
FIG. 1 shows a container with container corners according to the standard.
Figure 2A:
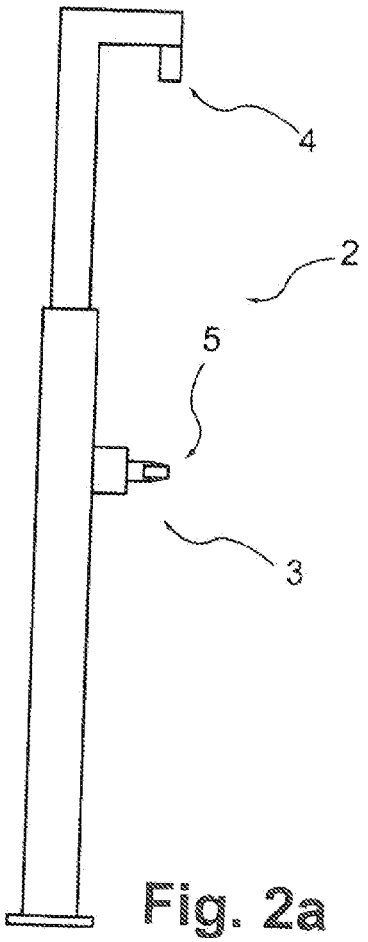
FIG. 2*a* shows a foot for a container.
Figure 2B:
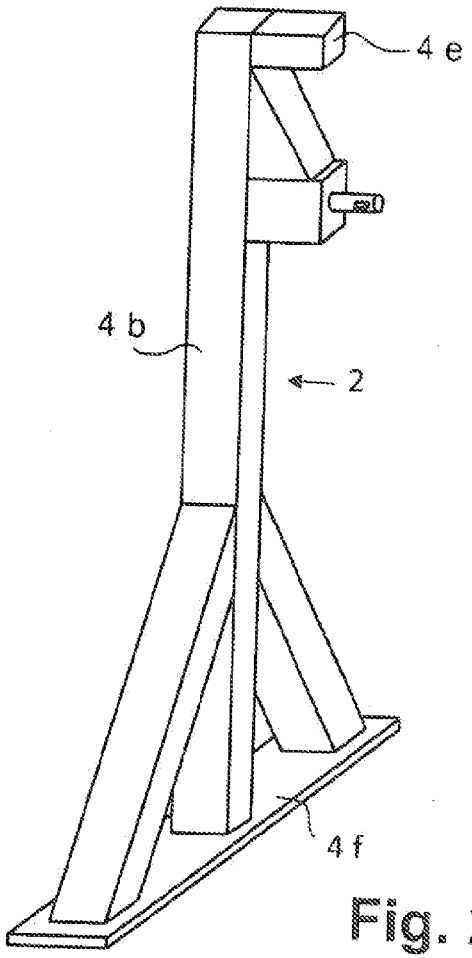
FIG. 2*b* shows a foot for a container according to another embodiment wherein in the top part of the foot stem 2 there is a supporting bracket 4*e* which will be situated against the wall of the container 1. The lower part of the foot stem 2 has been equipped with an elongated support plate 4*f* which will be situated against the ground.

The foot of the container in FIG. 2*b* operates in the same way as the above disclosed foot of the container, but the supporting bracket 4*e* at the top part of the foot stem leans against the wall of the container 1.

The invention claimed is:

1. A foot for a container which is removably attachable from the container, comprising:

an elongated foot stem for alignment with the container, the foot stem including oppositely disposed first and second ends, and, a first attachment lock intermediate the first and second ends, for engaging the container being pushed into a locking corner of the container, the first attachment lock including a locking tongue, the locking tongue including a horizontal shaft integral with at least one locking claw at one end of the horizontal shaft, the locking tongue being rotatable between an engagement position, where the locking tongue can be pushed onto the locking corner in the container, and a locking position, when the locking tongue is rotated approximately 90° from the engagement position, at which the locking tongue becomes locked into the locking corner of the container, wherein the first end of the foot stem includes a magnet for drawing the foot against the container.

2. A foot for a container according to claim 1, wherein the foot stem includes a support bracket for positioning against a wall of the container at the first end.

3. A foot for a container according to claim 2, wherein the foot stem includes an elongated support plate at the second end.

4. A foot for a container according to claim 1, additionally comprising a second attachment lock at the first end of the foot stem, the second attachment lock including a hook shaped locking bolt for locking into another locking corner in the container, the hook shape of the hook shaped locking bolt configured so that the end of the hook rests in a hole of the locking corner of the container.

5. A foot for a container according to claim 4, wherein the locking bolt includes a shaft which terminates at a square-shaped flat plate.

6. A foot for a container according to claim 1, wherein the elongated foot stem is formed of a pipe frame comprising A1 square pipes and pressfit laminated timber which stiffens the pipes and is positioned inside the pipes.

* * * * *

UNITED STATES PATENT AND TRADEMARK OFFICE

CERTIFICATE OF CORRECTION

PATENT NO. : 9,272,816 B2
APPLICATION NO. : 14/343055
DATED : March 1, 2016
INVENTOR(S) : Mikael Perttula et al.

It is certified that error appears in the above-identified patent and that said Letters Patent is hereby corrected as shown below:

Claims

Claim 1, Column 4, line 27 should be corrected as follows:
Change:
-- pushed onto --
to
"pushed into"

Signed and Sealed this
Third Day of May, 2016

Michelle K. Lee

Michelle K. Lee
*Director of the United States Patent and Trademark Office*